US006253681B1

(12) United States Patent
Roosmann et al.

(10) Patent No.: US 6,253,681 B1
(45) Date of Patent: Jul. 3, 2001

(54) SECURING DEVICE FOR ATTACHING A STABILIZING BAND TO AIR-DROPPED AMMUNITION

(75) Inventors: Karlheinz Roosmann, Fassberg-Müden; Adolf Weber, Neunkirchen, both of (DE)

(73) Assignee: Rheinmetal W & M. GmbH, Unterlüss (DE)

( * ) Notice: Subject to any disclaimer, the term of this patent is extended or adjusted under 35 U.S.C. 154(b) by 0 days.

(21) Appl. No.: 09/388,549

(22) Filed: Sep. 2, 1999

(30) Foreign Application Priority Data

Sep. 17, 1998 (DE) ..... 198 42 541

(51) Int. Cl.[7] ..... F42B 10/48

(52) U.S. Cl. ..... 102/386; 89/1.51; 89/1.54; 89/1.55

(58) Field of Search ..... 102/384, 386, 102/393; 89/1.51, 1.52, 1.54, 1.55

(56) References Cited

U.S. PATENT DOCUMENTS 4,762,066 * 8/1988 Rudenauer et al. ..... 102/226
5,016,533 * 5/1991 Borngen ..... 102/386
5,048,419 * 9/1991 Skowasch ..... 102/226
5,153,371 * 10/1992 Grau et al. ..... 102/386
5,251,562 * 10/1993 Chemiere et al. ..... 102/386

FOREIGN PATENT DOCUMENTS 2 672 673 8/1992 (FR) .

* cited by examiner

*Primary Examiner*—Charles T. Jordan
*Assistant Examiner*—Nicholas DiCostanzo
(74) *Attorney, Agent, or Firm*—Venable; Gabor J. Kelemen

(57) ABSTRACT

An air-dropped ammunition includes an ammunition body having a rearward portion; a firing pin accommodated in the rearward portion; a stabilizing band being received in a folded state at least partially in the rearward portion of the ammunition body; and a device for securing the stabilizing band to the firing pin. The device includes a disk having an upturned rim. The disk engages face-to-face one of two overlapping ends of the stabilizing band, and the upturned rim is oriented away from the overlapping ends. The overlapping ends and the disk are firmly attached to the firing pin.

3 Claims, 1 Drawing Sheet

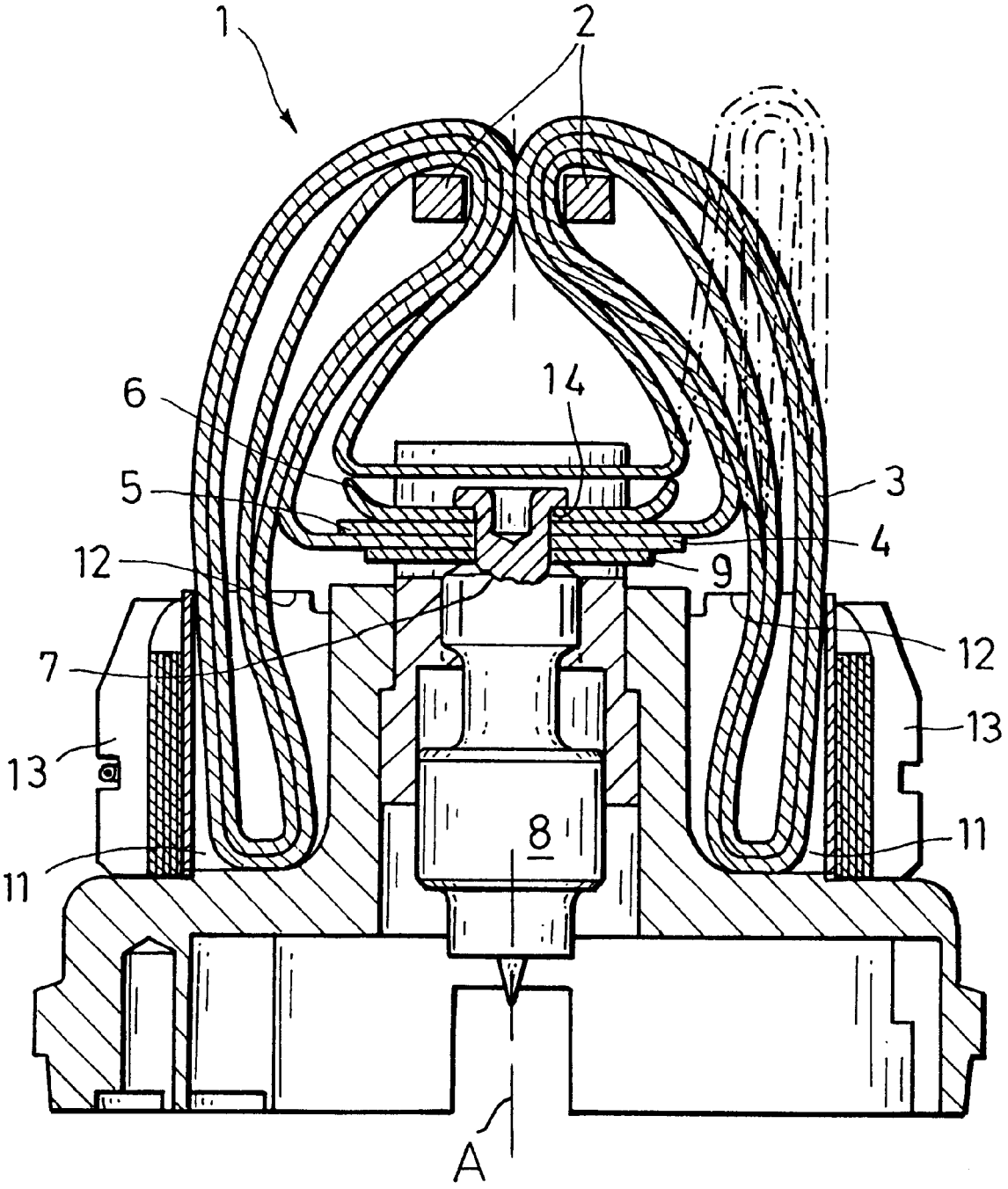
1
2
6
14
5
3
4
12
9
12
7
13
13
8
11
11
A

SECURING DEVICE FOR ATTACHING A STABILIZING BAND TO AIR-DROPPED AMMUNITION

CROSS REFERENCE TO RELATED APPLICATION

This application claims the priority of German Application No. 198 42 541.4 filed Sep. 17, 1998, which is incorporated herein by reference.

BACKGROUND OF THE INVENTION

This invention relates to a device for securing a stabilizing band to the rear portion of an air-dropped ammunition, such as a bomblet. The stabilizing band is folded into loops and is integrated into the rear part of the ammunition and has overlapping ends which are firmly connected with one end of a firing pin disposed in the rear portion of the ammunition.

A device for securing a stabilizing band of the above-outlined type is disclosed in published European Application 0 681 157. The stabilizing band disclosed therein is secured by means of a fit about a stable, face-to-face engaging small plate at the lower end of a bomblet (air-dropped ammunition). It is a disadvantage of such a prior art arrangement that because of the abrupt pulling load exerted on the deploying stabilizing band, the sharp edges of the small plate cut into the stabilizing band causing cuts or severance thereof.

Another securing device for a stabilizing band is disclosed in European Patent No. 0 538 083 which discloses an inwardly bent, essentially rectangular small, resilient plate which is shorter than the diameter of the bomblet and which is secured to the rearward portion thereof. It is the main purpose of such a small plate to effect a spreading (expansion) of the stabilizing band. For such a purpose the small plate has to be arranged radially with respect to the stabilizing band. It is a disadvantage of such a construction that the resilient plate is capable of taking up only very small tension forces so that the plate may buckle or break.

SUMMARY OF THE INVENTION

It is an object of the invention to provide an improved securing device of the above-discussed type which prevents cuts in the stabilizing band and by means of which force peaks are extenuated.

This object and others to become apparent as the specification progresses, are accomplished by the invention, according to which, briefly stated, the air-dropped ammunition includes an ammunition body having a rearward portion; a firing pin accommodated in the rearward portion; a stabilizing band being received in a folded state at least partially in the rearward portion of the ammunition body; and a device for securing the stabilizing band to the firing pin. The device includes a disk having an upturned rim. The disk engages face-to-face one of two overlapping ends of the stabilizing band, and the upturned rim is oriented away from the overlapping ends. The overlapping ends and the disk are firmly attached to the firing pin.

The invention is based on the principle to insert a rigid component having an upturned rim which retains a satisfactory deformability and energy attenuation despite large forces. According to a preferred embodiment, the component is a dished (bowl-shaped) disk. The advantage of such an embodiment resides in its simple manufacture and assembly.

BRIEF DESCRIPTION OF THE DRAWING

The sole FIGURE is an axial sectional view of a preferred embodiment of the invention.

DESCRIPTION OF THE PREFERRED EMBODIMENT

Turning to the FIGURE, for the sake of clarity only those components are provided with reference numerals which are necessary for explaining the invention.

A rearward portion 1 of an otherwise not illustrated ammunition body has, at its upper (that is, rearward) end, a stabilizing band 3 which is symmetrically folded relative to the ammunition axis A and which is held together in the folded state by a clip 2. The ends 4 and 5 of the stabilizing band 3 are preferably stiffened and are glued or sewn together in an overlapping state.

According to the invention, the band ends 4 and 5 are secured by a dished disk 6 to the upper end 7 of a firing pin 8. Underneath the disk 6 and the ends 4 and 5 a flat annular disk 9 is provided. The securement of the disk 6, the ends 4 and 5 as well as the annular disk 9 is effected by riveting these components to the upper end of the firing pin 8. The disk 6 is preferably of a material which is relatively deformable, despite its substantial rigidity due in part to its dished configuration. The clip 2 which holds together the upper ends of the band loops in a centered manner is, together with the upper loops, situated within and centrally with respect to, the circumferential outline of the rearward portion 1. The lower portions of the folded loops of the stabilizing band 3 are tucked into a recess 11 of the rearward portion 1 and are held therein by spinstabilized brakes 12.

The dished disk 6 is manufactured in a simple manner by stamping it from a sheet metal blank of approximately 0.5 mm thickness. The rim of the disk 6 has an inner radius of 1.0 to 1.7 mm, preferably 1.2 mm. The height of the upturned rim is preferably 1.5 mm (±0.22 mm). The dished disk 6 has a center bore 14 having a diameter of 2.0 to 3.0 mm, preferably 2.6 mm through which the connecting rivet passes. It is a further advantage of the dished disk 6 that the ends 4 and 5 of the stabilizing band 3 may be attached thereto in a simple manner. Thus, no radial alignment is needed, that is, the disk 6 does not have to be aligned with respect to the folding or loop direction of the stabilizing band 3. As a result, the disk 6 may have a smaller outer diameter, for example, less than 11.5 mm, than the width of the stabilizing band 3 measured perpendicularly to the plane of the drawing FIGURE.

In the description which follows the operation of the above-described device will be set forth.

As the ammunition is dropped from the air, securing shells 13 and the clip 2 are explosively removed. At the same time the spin-stabilized brakes 12 are released so that the stabilizing band 3 may deploy and form a single, large loop. The pulling forces generated during this occurrence affect particularly the band ends 4, 5. By virtue of the dished shape of the disk 6, the band 3 lies smoothly on the outer, convex surface of the disk 6 and thus the pulling forces are taken up by the disk 6 without the ends 4 and 5 suffering any cuts. The firing pin 8 secured to the disk 6 is brought into the firing position in a known manner.

It will be understood that the above description of the present invention is susceptible to various modifications, changes and adaptations, and the same are intended to be comprehended within the meaning and range of equivalents of the appended claims.

What is claimed is:

1. An air-dropped ammunition comprising (a) an ammunition body having a rearward portion;

(b) a firing pin accommodated in said rearward portion;

(c) a stabilizing band received in a folded state at least partially in said rearward portion; said stabilizing band having two overlapping ends; and (d) a device for securing said stabilizing band to said firing pin; said device including (1) a disk having an upturned rim; said disk engaging face-to-face one of said overlapping ends and said upturned rim being oriented away from said overlapping ends; and (2) attaching means for fixedly securing said overlapping ends and said disk to said firing pin.

2. The air-dropped ammunition as defined in claim 1, wherein said disk has a central bore and further wherein said attaching means comprises a rivet passing through said central bore and clamping said disk and said overlapping ends to a face of said firing pin.

3. The air-dropped ammunition as defined in claim 1, wherein said disk has an outer diameter and said stabilizing band has a width; said outer diameter being less than said width.

* * * * *